US006531810B2

(12) United States Patent
Bult et al.

(10) Patent No.: US 6,531,810 B2
(45) Date of Patent: Mar. 11, 2003

(54) ELECTRIC LOAD

(75) Inventors: Rene Vincentius Bult, Roosendaal (NL); Filip Jozef Suzanne Vereecken, Roosendaal (NL)

(73) Assignee: Koninklijke Philips Electronics N.V. (NL)

( * ) Notice: Subject to any disclaimer, the term of this patent is extended or adjusted under 35 U.S.C. 154(b) by 190 days.

(21) Appl. No.: 09/771,853

(22) Filed: Jan. 29, 2001

(65) Prior Publication Data

US 2001/0011866 A1 Aug. 9, 2001

(30) Foreign Application Priority Data

Feb. 3, 2000 (EP) ..... 00200369

(51) Int. Cl.[7] ..... H05B 41/08; H01R 12/00

(52) U.S. Cl. ..... 313/318.01; 174/50.53; 361/812; 439/231

(58) Field of Search ..... 313/594, 619, 313/623–26, 318.01, 318.05, 312.12; 174/50.52, 50.53, 50.56; 361/807–809, 812, 773, 774; 439/231, 232, 605, 699.2

(56) References Cited

U.S. PATENT DOCUMENTS 3,346,775 A * 10/1967 Christiansen ..... 361/774
3,780,327 A 12/1973 Vervaart et al. ..... 313/151
6,018,285 A * 1/2000 Maeda ..... 361/773

* cited by examiner

*Primary Examiner*—Joan Pendegrass
(74) *Attorney, Agent, or Firm*—Dicran Halajian; Frank J. Keegan

(57) ABSTRACT

The electric load comprises a carrier plate (1) of a synthetic resin material, at a first side (2) of which, synthetic resin projections (30) are present, which serve as a means for coupling the electric load to a holder. The projections (30) have a leg (31) with a disc, which faces away from the plate (1), and a channel (33) accommodating a current conductor (5) of a load element (4), which is present at a first side (3) of the plate (1). The disc has a circumferential side face (35), which is covered with an electric conductor (20) as a contact, to which a respective current conductor (5) is connected. The electric load, for example a fluorescent lamp switch, is of a simple construction that can be manufactured at low costs.

7 Claims, 2 Drawing Sheets

ELECTRIC LOAD

The invention relates to an electric load comprising a carrier plate of an insulating material, at a first side of which, there are contacts and means for mechanically coupling the load to a holder, and at a second side of which, there is a load element, which load element has current conductors, which are connected to a respective contact.

Such an electric load is disclosed, for example, in U.S. Pat. No. 3,780,327.

The known load is a glow switch, which can be used to ignite low-pressure mercury vapor lamps, such as fluorescent lamps. The contacts of said glow switch are brass pins having a first constriction between their free end and the plate. In commercially available glow switches, the carrier plate is made of hard paper, and the pins have a second constriction which is inserted in an opening in the carrier plate, so that the first constriction forms a stop at the first side of the plate. From the second end, t he pins are provided with a bore wherein the relevant current conductor is fixed. Said second end is curled over so as to fix the pin in the carrier plate.

In the known load, the contacts also serve as the means for mechanically coupling the load to a holder. For this purpose, the holder has a wall with arc-shaped slots having a circular opening at one end. When the load is placed in the holder, the free ends of the contacts are passed through a respective opening and the load is turned, causing the first constriction to move through a relevant slot towards an end position. As a result, the load is mechanically coupled to the holder. In addition, the free ends of the contacts make lateral, electric contact with the holder.

A drawback of the known electric load resides in that the contacts have a comparatively large material content. Another drawback resides in that the contacts are difficult to manufacture. These drawbacks result in a comparatively high cost price of the contacts and hence the load.

It is an object of the invention to provide an electric load of the type described in the opening paragraph, the construction of which is simple and readily manufacturable at comparatively low costs.

In accordance with the invention, this object is achieved in that the carrier plate comprises synthetic resin projections, which serve as means for coupling the load to a holder, which projections are provided with a shank with a disc at some distance from the carrier plate, which projections are further provided with a duct accommodating one of the current conductors, which disc has an end face facing away from the carrier plate and a circumferential side face, at least the side face being covered with an electric conductor, which is connected as a contact to the relevant current conductor.

In the load in accordance with the invention, comparatively large brass parts are replaced with synthetic resin projections. The synthetic resin projections serve as means for coupling the load to a holder, and they are also used as contact carriers. As a result, the contacts are much smaller than the contacts of the known load and have a much smaller material content. Synthetic resin can be readily shaped in a mold, and is a comparatively inexpensive material. It is sufficient to cover the side face, i.e. the face of the projection, with an electric conductor. The side face must actually be electrically connected with the holder.

The projections and the carrier plate can be joined to each other, for example by fusing or bonding, but, advantageously, the projections are integral with the carrier plate. The carrier plate with the projections may be made, for example, from a thermoplast, such as polyamide or polycarbonate.

In a favorable embodiment, also the end face is covered with the electric conductor. As a result, the projection may have a wholly axially extending duct for accommodating a current conductor, which can be connected at the end face to the electric conductor. By virtue thereof, the projections, or the carrier plate including the projections, can be manufactured even more readily. The end face may be provided with a recess around the duct, in which recess the current conductor is connected to the electric conductor, so that the connection is recessed. The connection may be formed, for example, using solder or by means of drop-deposition of a metal.

The electric conductor may be a coating, for example of a metal. It is favorable, however, if the electric conductor is a metal body, for example of brass, which is secured to the projection. In the latter case, the body is, for example, a cylindrical body which is open on two sides or a cylindrical body having a bottom portion, which bottom portion covers the end face of the projection. The body may be fixed in position by curling it around the disc of the relevant projection. The body may alternatively be in tight working contact with the projection, for example through a press fit. In this case, the current conductor, which is bent back around the disc, may also be tightly fitted. Alternatively, the carrier plate with the projections may be formed in a mold in the presence of the metal bodies. This method of manufacturing is referred to as "insertion molding".

In a favorable embodiment, the electric conductor is a cylindrical body having a bottom portion and a tubular portion extending in the body of the bottom portion, which tubular portion is accommodated in the duct of the projection. This embodiment has the advantage that the current conductor and the electric conductor co-operate telescopically. This enables the load element to be readily positioned at a predetermined distance from the carrier plate, whereafter the current conductors are connected to the electric conductor by means of, for example, solder. In addition, this embodiment has the advantage that the carrier is provided with the means for coupling to a holder, and with the contacts, prior to being united with the load element.

In a modification, the shank of the projection has a radial bore which opens into the duct, and the tubular portion is indented via the bore so as to keep the current conductor in a fixed position. This modification has the advantage that only one mechanical operation has to be carried out to make a connection between the current conductor and the electric conductor.

The metal body present at the projections can be easily manufactured in an accurate and comparatively cheap manner by machining, for example, brass, in which operation the material is upset and formed.

The electric load may be, for example, an electric lamp, such as a LED or an incandescent lamp, in which case the load element comprises a light-emitting diode or an incandescent body, respectively. The electric load may alternatively be a switch, for example a glow switch, which is used, for example, to ignite a low-pressure mercury vapor lamp, such as a fluorescent lamp. In this case, the load element may comprise, for example, an electrode and a bimetal electrode in an envelope filled with an inert gas, which may be bridged (?) by an anti-interference capacitor. The load element may be accommodated in a, for example synthetic resin, housing which is attached to the carrier.

These and other aspects of the invention will be apparent from and elucidated with reference to the embodiment(s) described hereinafter.

In the drawings.

The Figures are purely diagrammatic and not drawn to scale. Particularly for clarity, some dimensions are exaggerated strongly. In the Figures, like reference numerals refer to like parts whenever possible.

Figure 1A:
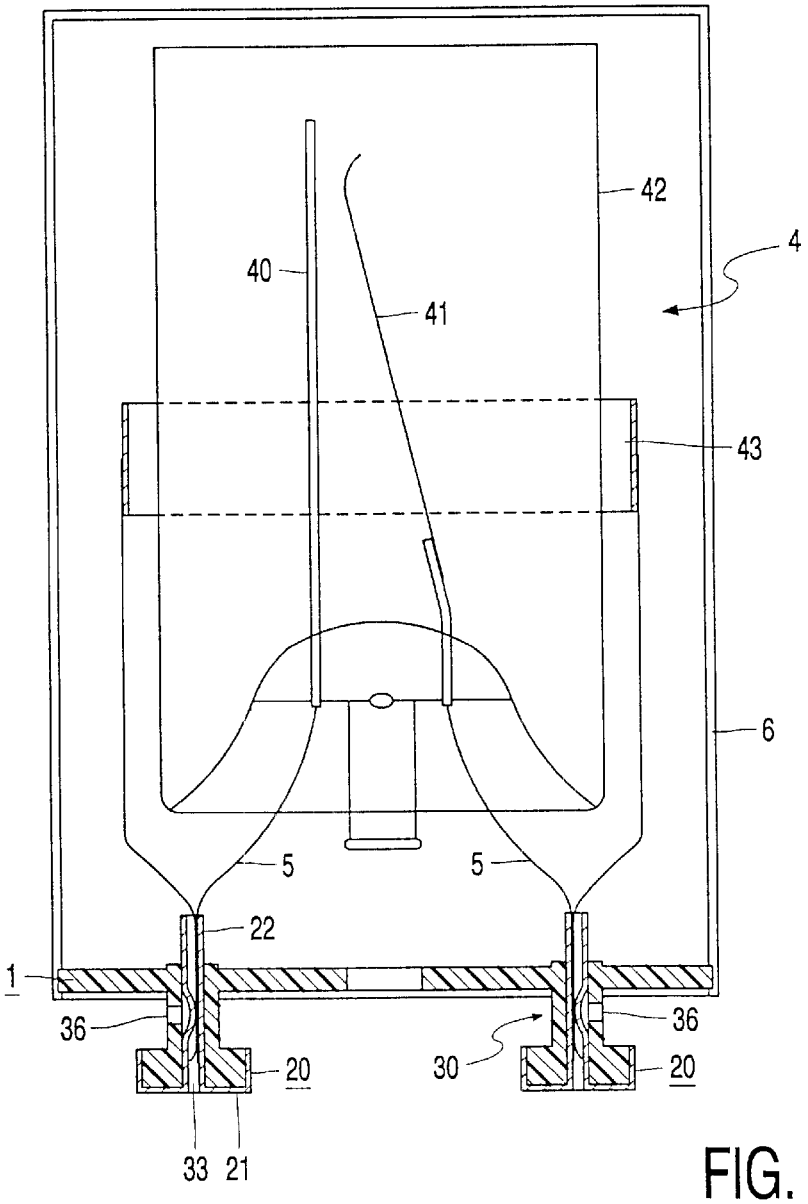
FIG. 1A shows a load in side view, partly in section.
Figure 1B:
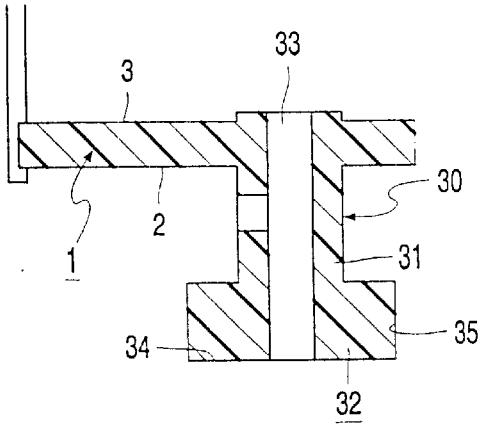
FIG. 1B shows a detail of FIG. 1A.

The electric load shown in FIGS. 1A and 1B is provided with a carrier plate 1 of an insulating material, at a first side 2 of which there are contacts and means for mechanically coupling the load to a holder, and at a second side 3 of said carrier plate there is a load element 4. Said load element 4 has current conductors 5, which are connected to a respective contact.

Figure 2:
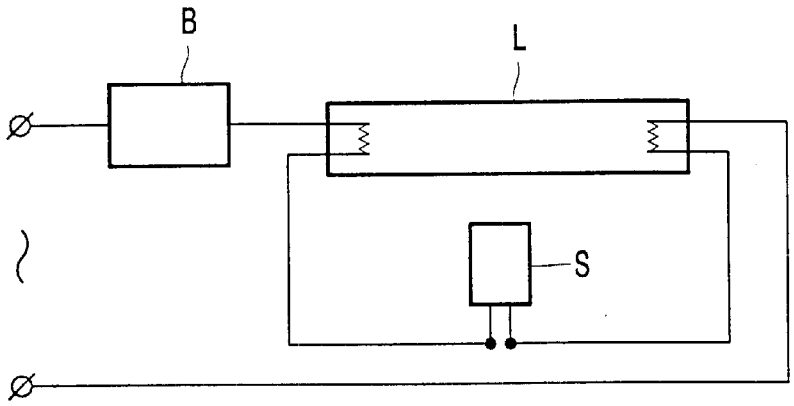
FIG. 2 shows an electrical circuit diagram including the load shown in FIG. 1.

The load shown in FIG. 1A is a switch S, which forms part, as shown in FIG. 2, of a circuit comprising a ballast B and a fluorescent lamp L. The load element 4 shown in FIG. 1A comprises a first electrode 40 and a second, bimetal electrode 41 in an envelope 42 filled with an inert gas. The electrodes 40, 41 are bridged by an anti-interference capacitor 43. The electrodes 40, 41 are connected to a respective current conductor 5.

If a voltage is applied across the switch S in the circuit shown in FIG. 2, then a glow discharge develops between the electrodes 40, 41, which glow discharge heats said electrodes. Said heating causes the bimetal electrode 41 to curve, as a result of which the distance between the electrodes 40, 41 becomes so large that the glow discharge is extinguished. The ballast B, which is connected in series with the switch S, then applies a voltage pulse across the fluorescent lamp L, which is connected in parallel with the switch S, as a result of which the lamp can ignite. If the lamp fails to ignite, then the process is repeated when, as a result of cooling, the bimetal electrode 41 has come close to the first electrode 40 again.

In FIGS. 1A and 1B, the carrier plate 1 comprises synthetic resin projections 30, which serve as means for coupling the load to a holder. Said projections include a shank 31 having a disc 32 at some distance from the carrier plate 1, and a duct 33 accommodating one of the current conductors 5. The disc 32 has an end face 34 facing away from the carrier plate 1, and a circumferential side face 35, at least said side face 35 (see FIG. 1A) being covered with an electric conductor 20, which is connected as a contact to the relevant current conductor 5.

In the embodiment shown, the projections 30 are integral with the carrier plate 1, and also their end face 35 is covered with the electric conductor 20. The carrier plate is made of polyamide.

In FIG. 1A, the electric conductor 20 is a cylindrical, metal body, which is attached to the projection 30.

In FIG. 1A, the electric conductor 20 is a cylindrical, metal body, which is in tight working contact with the projection 30.

Said cylindrical metal body of the conductor 20 has a bottom portion 21 and a tubular portion 22, which extends in the body of the bottom portion 21 and is accommodated in the duct 33 of the projection 30. Said body is made from brass.

The shank 31 of the projections 30 has a radial bore 36, which opens into the duct 33. The tubular portion 32 is indented via the bore 36 so as to keep the current conductor 5 in a fixed position.

In FIG. 1A, the load element 4 is accommodated in a transparent housing 6, which is connected to the carrier plate 1 by means of a click connection.

In the embodiment shown, the carrier plate 1 including the projections 30 can readily be formed by "insertion molding" in the presence of the metal bodies 20. Subsequently, the embodiment can be obtained by carrying out only mechanical assembly operations.

The electric load is of a simple construction, which is readily manufacturable at comparatively low costs.

Figure 3:
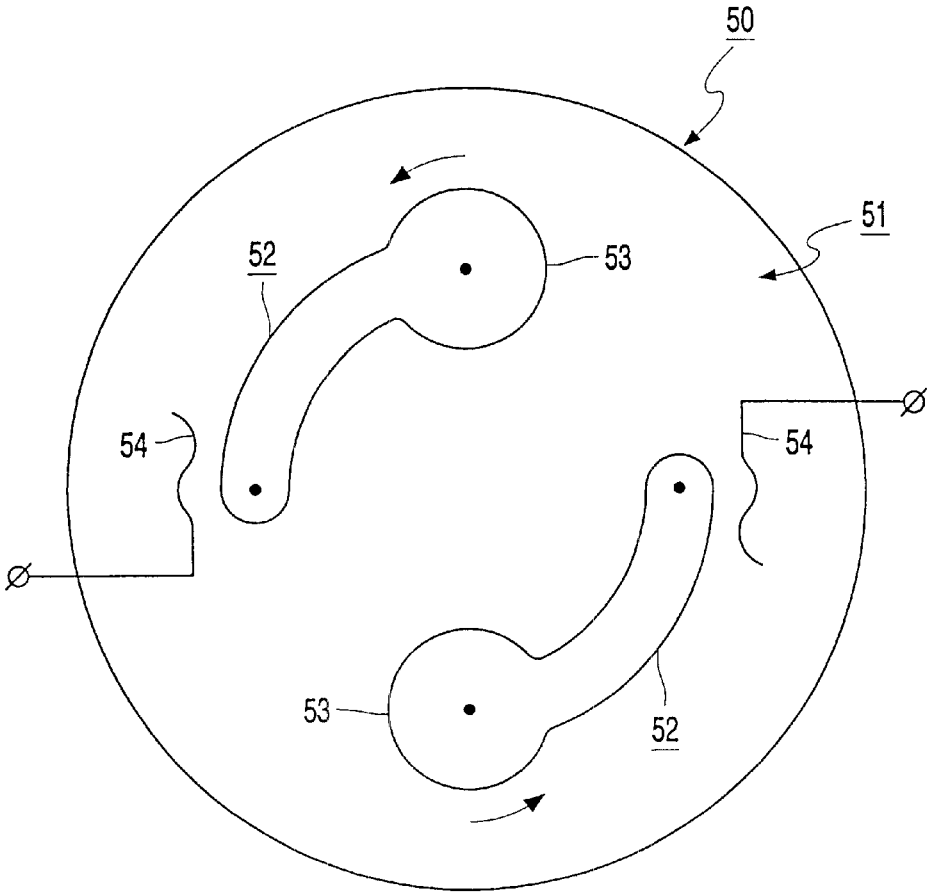
FIG. 3 is an interior view of a holder for the load shown in FIG. 1.

In FIG. 3, the holder 50 for the load shown in FIG. 1A has a wall 51 wherein arc-shaped slots 52 are present, which are provided, at the front ends, with a circular widening 53 and, towards the rear ends, with electrical contacts 54. If the discs 32 of the projections 30 of the load shown in FIG. 1A are passed through a respective widened portion 53, viewed from behind the plane of the drawing, and if the load is subsequently rotated in the direction indicated by means of the arrows, the shanks 31 of the projections 30 move through the slots 52. The side face 35 of the projections 30 then contacts, via the electric conductor 20 present on said side face, the electric contacts 54 of the holder 50. The shanks 31 are substantially accommodated in the slots 52 in the wall 51, which is one reason why they cannot be reached by the electric contacts 54, the other reason being the distance between these contacts 54 and the slots 52.

It will be obvious that, within the scope of the invention, many variations are possible to those skilled in the art.

The scope of protection of the invention is not limited to the examples given hereinabove. The invention is embodied in each novel characteristic and each combination of characteristics. Reference numerals in the claims do not limit the scope of protection thereof. The use of the verb "to comprise" and its conjugations does not exclude the presence of elements other than those mentioned in the claims. The use of the article "a" or "an" in front of an element does not exclude the presence of a plurality of such elements.

What is claimed is:

1. An electric load comprising a carrier plate (1) of an insulating material, at a first side (2) of which, there are contacts and means for mechanically coupling the load to a holder, and at a second side (3) of which, there is a load element (4), which load element (4) has current conductors (5), which are connected to a respective contact, characterized in that the carrier plate (1) comprises synthetic resin projections (30), which serve as means for coupling the load to a holder, which projections are provided with a shank (31) with a disc (32) at some distance from the carrier plate (1), which projections are further provided with a duct (33) accommodating one of the current conductors (5), which disc (32) has an end face (34) facing away from the carrier plate (1) and a circumferential side face (35), at least the side face (35) being covered with an electric conductor (20), which is connected as a contact to the relevant current conductor (5).

2. An electric load as claimed in claim 1, characterized in that the projections (30) are integral with the carrier plate (1).

3. An electric load as claimed in claim 2, characterized in that also the end face (34) is covered with the electric conductor (20).

4. An electric load as claimed in claim 2, characterized in that the electric conductor (20) is a cylindrical, metal body, which is secured to the projection (30).

5. An electric load as claimed in claim 2, characterized in that the electric conductor (20) is a cylindrical, metal body, which is in tight working contact with the projection (30).

6. An electric load as claimed in claim 5, characterized in that the electric conductor (20) is a cylindrical, metal body having a bottom portion (21) and a tubular portion (22), which extends in the body of the bottom portion (21) and is accommodated in the duct (33) of the projection (30).

7. An electric load as claimed in claim 6, characterized in that the shank (31) of the projection (30) has a radial bore (36), which opens into the duct (33), and the tubular portion (22) is indented via the bore (36) in order to keep the current conductor (5) in a fixed position.

* * * * *